US012527359B2

(12) United States Patent
Li et al.

(10) Patent No.: US 12,527,359 B2
(45) Date of Patent: Jan. 20, 2026

(54) ELECTRONIC VAPORIZATION DEVICE AND HEATING METHOD AND LIQUID CONTENT DETECTION METHOD

(71) Applicant: SHENZHEN SMOORE TECHNOLOGY LIMITED, Guangdong (CN)

(72) Inventors: Jun Li, Shenzhen (CN); Zhaohuan Zeng, Shenzhen (CN); Hua Tan, Shenzhen (CN); Danchong He, Shenzhen (CN); Pifa Shen, Shenzhen (CN); Ruofei Yan, Shenzhen (CN); Tao Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 379 days.

(21) Appl. No.: 18/081,270

(22) Filed: Dec. 14, 2022

(65) Prior Publication Data

US 2023/0200454 A1 Jun. 29, 2023

(30) Foreign Application Priority Data

Dec. 28, 2021 (CN) ..... 202111625415.4

(51) Int. Cl.
*A24F 40/10* (2020.01)
*A24F 40/42* (2020.01)
(Continued)

(52) U.S. Cl.
CPC ..... *A24F 40/57* (2020.01); *A24F 40/10* (2020.01); *A24F 40/42* (2020.01); *A24F 40/485* (2020.01); *A24F 40/51* (2020.01)

(58) Field of Classification Search
CPC ..... A24F 40/10; A24F 40/42; A24F 40/485; A24F 40/51; A24F 40/53; A24F 40/57
See application file for complete search history.

(56) References Cited

U.S. PATENT DOCUMENTS

2018/0049469 A1* 2/2018 Kaufman ..... G01D 5/24
2019/0167922 A1* 6/2019 Cole ..... A24F 40/48
(Continued)

FOREIGN PATENT DOCUMENTS

CN 107156911 A 9/2017
CN 107249360 A 10/2017
(Continued)

OTHER PUBLICATIONS

Japanese Patent Office, Notice of Reasons for Refusal in Japanese Patent Application No. 2022-176538 (Dec. 5, 2023).
(Continued)

*Primary Examiner* — Abdullah A Riyami
*Assistant Examiner* — Thang H Nguyen
(74) *Attorney, Agent, or Firm* — Leydig, Voit & Mayer, Ltd.

(57) ABSTRACT

An electronic vaporization device includes: a first conductor for accommodating an aerosol-generation product; a second conductor spaced apart from the first conductor; and a control unit for: obtaining an electrical parameter between the first conductor and the second conductor when the first conductor and the second conductor are electrically connected by the aerosol-generation product, obtaining a liquid content of the aerosol-generation product according to the electrical parameter, and controlling, according to the liquid content of the aerosol-generation product, a heating element to heat the aerosol-generation product.

17 Claims, 8 Drawing Sheets

(51) Int. Cl.

| | |
|---|---|
| ***A24F 40/485*** | (2020.01) |
| ***A24F 40/50*** | (2020.01) |
| ***A24F 40/51*** | (2020.01) |
| ***A24F 40/57*** | (2020.01) |

(56) References Cited

U.S. PATENT DOCUMENTS

| | | | | |
|---|---|---|---|---|
| 2019/0261683 | A1 | 8/2019 | Reevell | |
| 2021/0112868 | A1* | 4/2021 | Han | A24F 40/10 |
| 2022/0125110 | A1* | 4/2022 | Frake | A24D 1/20 |
| 2023/0095903 | A1* | 3/2023 | Kaihatsu | A24F 40/57 131/329 |
| 2023/0263218 | A1* | 8/2023 | Jang | A24F 40/42 |

FOREIGN PATENT DOCUMENTS

| | | | | |
|---|---|---|---|---|
| CN | 107949287 | A | 4/2018 | |
| CN | 209284327 | U | 8/2019 | |
| CN | 113382646 | A | 9/2021 | |
| CN | 216853830 | U | 7/2022 | |
| EP | 0893071 | B1 | 3/2002 | |
| JP | 2000298052 | A | 10/2000 | |
| JP | 2002195867 | A | 7/2002 | |
| JP | 2010210269 | A | 9/2010 | |
| JP | 2013210193 | A | 10/2013 | |
| JP | 2017510270 | A | 4/2017 | |
| JP | 2018532390 | A | 11/2018 | |
| JP | 2018532399 | A | 11/2018 | |
| JP | 2020508646 | A | 3/2020 | |
| JP | 2021519081 | A | 8/2021 | |
| JP | 2021534731 | A | 12/2021 | |
| WO | 2020097080 | A1 | 5/2020 | |
| WO | 2021038046 | A1 | 3/2021 | |
| WO | WO-2021240400 | A1 * | 12/2021 | A24F 40/42 |

OTHER PUBLICATIONS

Japanese Patent Office, Decision of Refusal in Japanese Patent Application No. 2022-176538 (Apr. 23, 2024).

European Patent Office, Search Report in European Patent Application No. 22214544.3 (May 30, 2023).

Chinese Patent Office, Office Action in Chinese Patent Application No. 202111625415.4 (Feb. 19, 2025).

Korean Patent Office, Office Action in Korean Patent Application No. 10-2022-0146869 (Mar. 4, 2025).

Korean Patent Office, Notice of Allowance in Korean Patent Application No. 10-2022-0146869 (May 13, 2025).

Chinese Patent Office, Notification of grant of patent right for invention in Chinese Patent Application No. 202111625415.4 (Jun. 20, 2025).

* cited by examiner

ELECTRONIC VAPORIZATION DEVICE AND HEATING METHOD AND LIQUID CONTENT DETECTION METHOD

CROSS-REFERENCE TO PRIOR APPLICATION

Priority is claimed to Chinese Patent Application No. 202111625415.4, filed on Dec. 28, 2021, the entire disclosure of which is hereby incorporated by reference herein.

FIELD

This application relates to the field of electronic vaporization devices, and in particular, to an electronic vaporization device and a heating method and a liquid content detection method.

BACKGROUND

An electronic vaporization device may be configured to heat and vaporize aerosol-generation products, for example, bake a solid substrate of plant leaves with a specific aroma in a heat-not-burning manner so that the solid substrate of leaves is baked into an aerosol. Further, Plant leaves may be added with ingredients such as flavors and fragrances, and then baked and mixed into an aerosol, so that the aerosol has a desired aroma.

Currently, a plurality of aerosol-generation products are usually packaged in a pack. Consumption of a pack of aerosol-generation products lasts for two to three days or more after opening.

However, after a packaging box of the aerosol-generation products is opened, the aerosol-generation products in the packaging box absorb moisture in the air. A water content in the aerosol-generation products increases with time, resulting in damping. As a result, a heating effect is undesirable or a volume of vaporized aerosols is small, which affects user experience.

SUMMARY

In an embodiment, the present invention provides an electronic vaporization device, comprising: a first conductor configured to accommodate an aerosol-generation product; a second conductor spaced apart from the first conductor; and a control unit configured to: obtain an electrical parameter between the first conductor and the second conductor when the first conductor and the second conductor are electrically connected by the aerosol-generation product, obtain a liquid content of the aerosol-generation product according to the electrical parameter, and control, according to the liquid content of the aerosol-generation product, a heating element to heat the aerosol-generation product.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
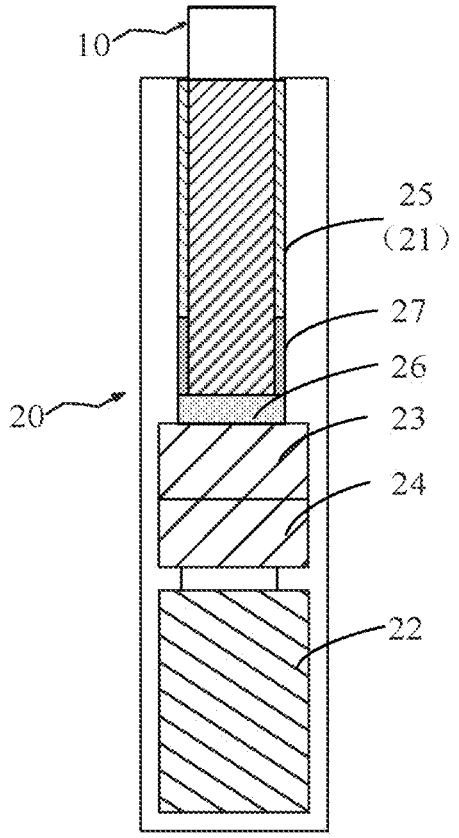
FIG. 1 is a schematic structural diagram of an electronic vaporization device according to an embodiment of this application.

In an embodiment, the present invention provides an electronic vaporization device and a heating method and a liquid content detection method, which can obtain a liquid content of an aerosol-generation product and control heating of the aerosol-generation product according to the liquid content of the aerosol-generation product, thereby ensuring a vaporization effect.

In an embodiment, the present invention provides an electronic vaporization device, including a first conductor, a second conductor, and a control unit. The first conductor is configured to accommodate an aerosol-generation product. The second conductor is spaced apart from first conductor. The control unit is configured to: obtain an electrical parameter between the first conductor and the second conductor when the first conductor and the second conductor are electrically connected by the aerosol-generation product, obtain a liquid content of the aerosol-generation product according to the electrical parameter, and control, according to the liquid content of the aerosol-generation product, a heating element to heat the aerosol-generation product.

The control unit further includes a sampling unit configured to collect the electrical parameter between the first conductor and the second conductor when the first conductor and the second conductor are electrically connected by the aerosol-generation product. The sampling unit is further configured to collect an initial electrical parameter between the first conductor and the second conductor when the first conductor and the second conductor are not electrically connected by the aerosol-generation product.

The control unit is further configured to: obtain a first difference between the electrical parameter and the initial electrical parameter, compare the difference with a preset threshold to obtain a second difference, and compare the liquid content of the aerosol-generation product according to the second difference.

The control unit controls the heating element to heat the aerosol-generation product based on the liquid content of the aerosol-generation product.

The control unit selects a preset heating curve matching the liquid content of the aerosol-generation product from a pre-stored preset heating curve set, where a time and/or a temperature in a different preset heating curve in the preset heating curve set for preheating the aerosol-generation product varies.

The control unit compensates for the pre-stored preset heating curve according to the liquid content of the aerosol-generation product, so as to change the time and/or the temperature in the preset heating curve for preheating the aerosol-generation product.

The first conductor is a hollow columnar body and is used as the heating element.

The electronic vaporization device further includes an electromagnetic coil surrounding the first conductor. The first conductor is configured to generate heat by electromagnetic induction.

The electronic vaporization device further includes an insulator arranged between the first conductor and the second conductor for spacing the first conductor apart from the second conductor. The insulator has a through hole, and the aerosol-generation product passes through the first conductor and the insulator and is electrically connected to the second conductor.

The electrical parameter includes a capacitance value and/or a resistance value.

In order to resolve the above technical problem, a second technical solution provided in this application is as follows: A method for detecting a liquid content of an aerosol-generation product is provided, including: spacing a first conductor apart from a second conductor; electrically connecting the first conductor to the second conductor through the aerosol-generation product; obtaining an electrical parameter between the first conductor and the second conductor; and obtaining a liquid content of the aerosol-generation product according to the electrical parameter.

The step of obtaining the liquid content of the aerosol-generation product according to the electrical parameter includes: obtaining a first difference between the electrical parameter and an initial electrical parameter, where the initial electrical parameter is an electrical parameter when the first conductor and the second conductor are not electrically connected by the aerosol-generation product; comparing the difference with a preset threshold to obtain a second difference; and obtaining the liquid content of the aerosol-generation product according to the second difference.

Before the step of electrically connecting the first conductor to the second conductor through the aerosol-generation product, the method further includes: collecting the initial electrical parameter between the first conductor and the second conductor.

The electrical parameter includes a capacitance value and/or a resistance value.

In order to resolve the above technical problem, a third technical solution provided in this application is as follows: A method for heating an aerosol-generation product by an electronic vaporization device, including: obtaining a liquid content of an aerosol-generation product; and controlling, according to the liquid content of the aerosol-generation product, a heating element to heat the aerosol-generation product.

The step of obtaining the liquid content of the aerosol-generation product includes: collecting an electrical parameter between the first conductor and the second conductor in response to the first conductor and the second conductor that are spaced apart from each other being electrically connected by the aerosol-generation product; and obtaining a liquid content of the aerosol-generation product according to the electrical parameter.

The step of obtaining the liquid content of the aerosol-generation product according to the electrical parameter includes: obtaining a first difference between the electrical parameter and an initial electrical parameter, where the initial electrical parameter is an electrical parameter when the first conductor and the second conductor are not electrically connected by the aerosol-generation product; comparing the difference with a preset threshold to obtain a second difference; and obtaining the liquid content of the aerosol-generation product according to the second difference.

The step of controlling, according to the liquid content of the aerosol-generation product, a heating element to heat the aerosol-generation product includes: selecting a preset heating curve matching the liquid content of the aerosol-generation product from pre-stored preset heating curves, where a time and/or a temperature in a different one of the plurality of preset heating curves for preheating the aerosol-generation product varies; and controlling, according to the preset heating curve, the heating element to increase or reduce the preheating time for the aerosol-generation product.

The step of controlling, according to the liquid content of the aerosol-generation product, a heating element to heat the aerosol-generation product includes: compensating the pre-stored preset heating curve according to the liquid content of the aerosol-generation product, so as to change the time and/or the temperature in the preset heating curve for preheating the aerosol-generation product.

The electrical parameter includes a capacitance value and/or a resistance value.

Beneficial effects of this application are as follows. Different from those in the prior art, in the electronic vaporization device and the heating method and the liquid content detection method provided a first conductor, a second conductor, and a control unit are included. The first conductor is configured to accommodate an aerosol-generation product. The second conductor is spaced apart from first conductor. The control unit is configured to: obtain an electrical parameter between the first conductor and the second conductor when the first conductor and the second conductor are electrically connected by the aerosol-generation product, obtain a liquid content of the aerosol-generation product according to the electrical parameter, and control, according to the liquid content of the aerosol-generation product, a heating element to heat the aerosol-generation product. Since the liquid content of the aerosol-generation product is obtained, and the aerosol-generation product is heated according to the liquid content of the aerosol-generation product, user experience can be effectively improved.

The technical solutions in the embodiments of this application are clearly and completely described in the following with reference to the accompanying drawings in the embodiments of this application. Apparently, the described embodiments are merely some rather than all of the embodiments of this application. All other embodiments obtained by a person skilled in the art based on the embodiments of this application without creative efforts shall fall within the protection scope of this application.

Figure 2:
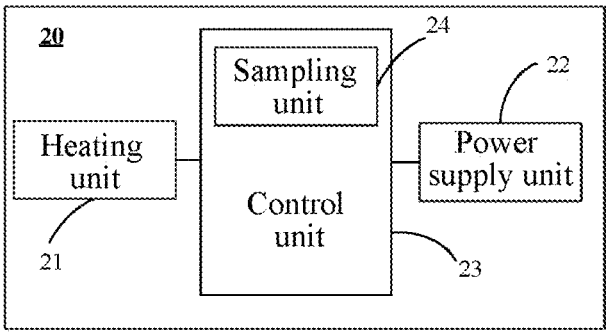
FIG. 2 is a schematic diagram of functional modules of the electronic vaporization device according to an embodiment of this application.
Figure 3:
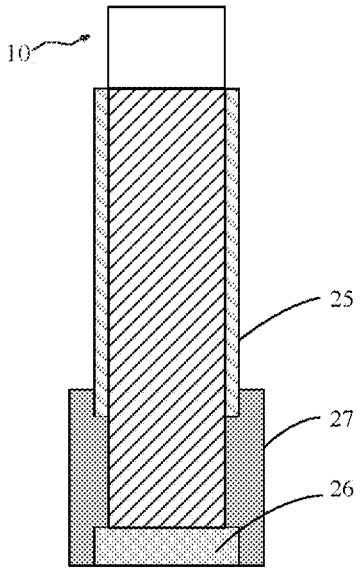
FIG. 3 is a schematic structural diagram of a first conductor, a second conductor, and an aerosol-generation product according to an embodiment of this application.
Figure 4:
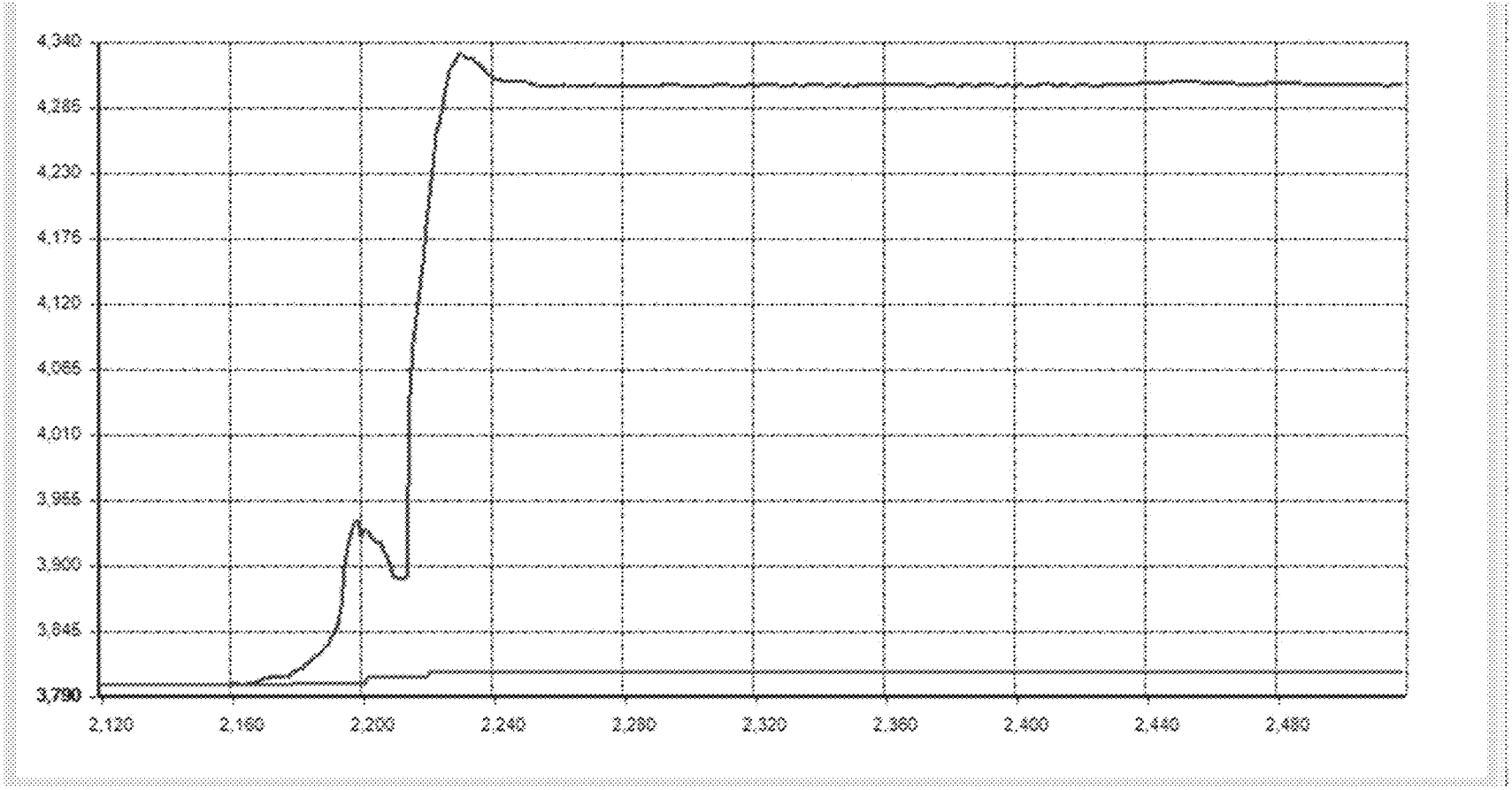
FIG. 4 is a dielectric constant-time relationship diagram of an aerosol-generation product after one day since opening according to an embodiment of this application.
Figure 5:
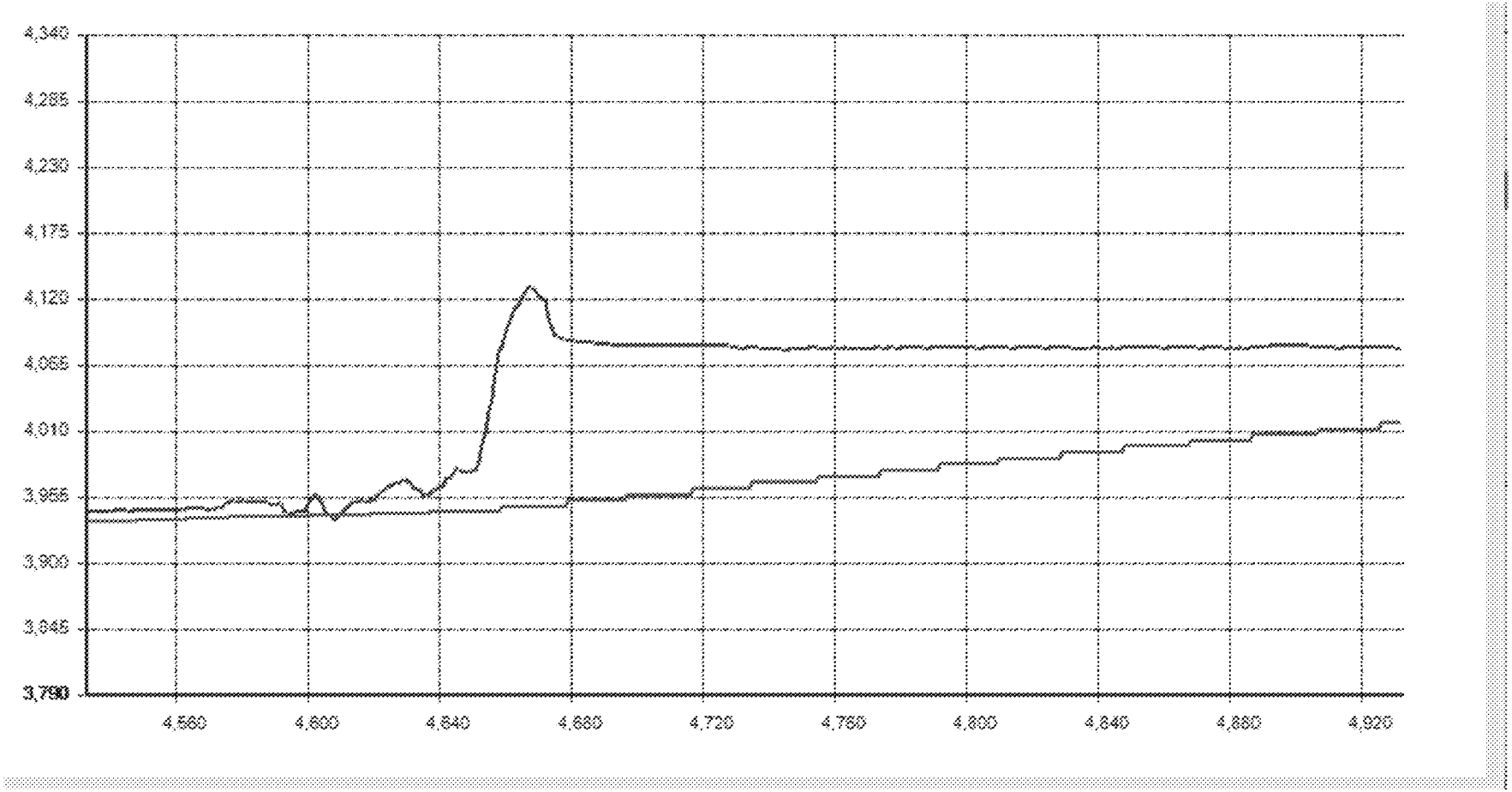
FIG. 5 is a dielectric constant-time relationship diagram of an aerosol-generation product that is recently opened according to an embodiment of this application.
Figure 6:
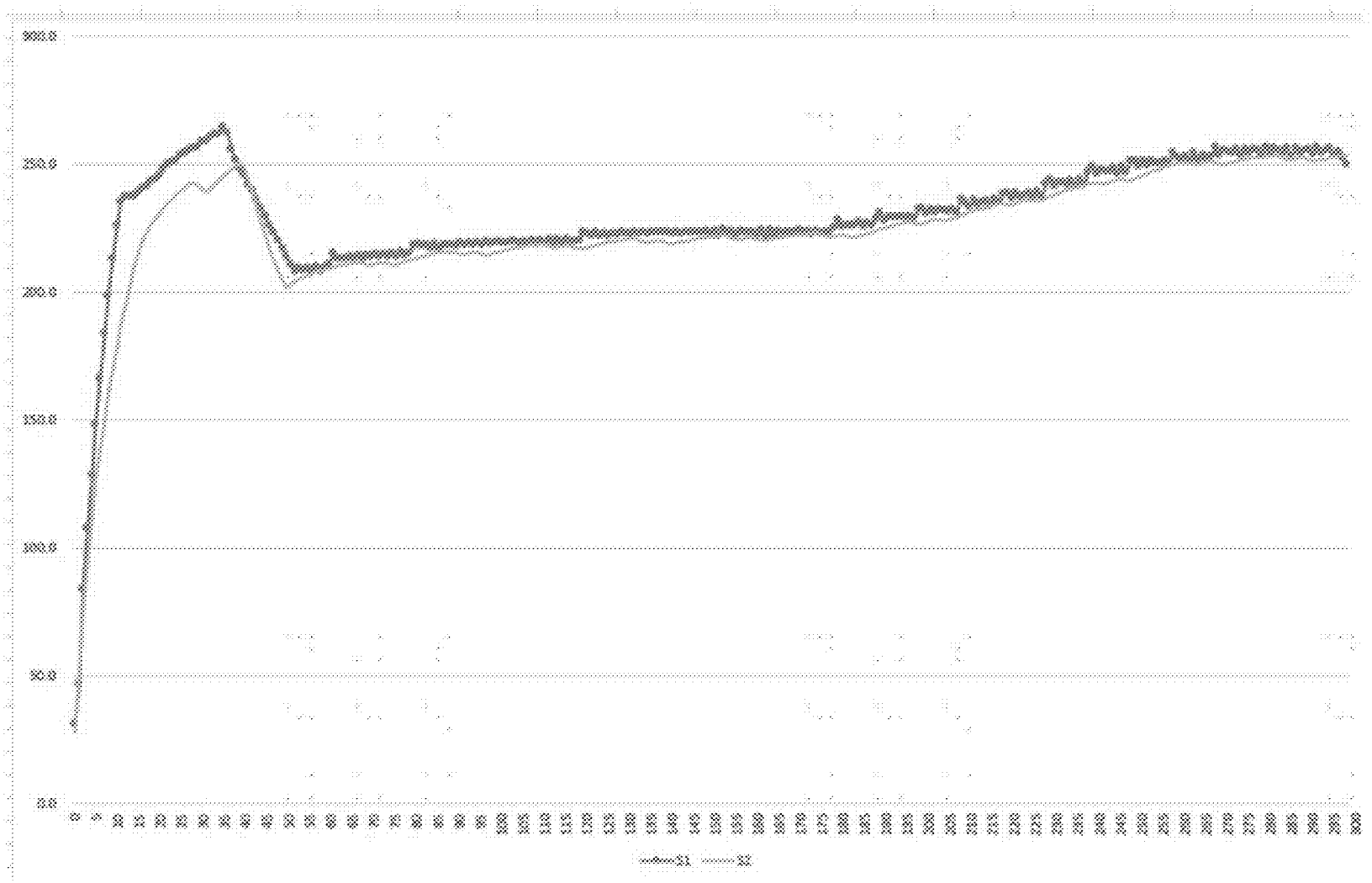
FIG. 6 shows different preset heating curves outputted by a control unit according to a liquid content of the aerosol-generation product according to an embodiment of this application.

FIG. 1 is a schematic structural diagram of an electronic vaporization device according to an embodiment of this application. FIG. 2 is a schematic diagram of functional modules of the electronic vaporization device according to an embodiment of this application. FIG. 3 is a schematic structural diagram of a first conductor, a second conductor, and an aerosol-generation product according to an embodiment of this application. FIG. 4 is a dielectric constant-time relationship diagram of an aerosol-generation product after one day since opening according to an embodiment of this application. FIG. 5 is a dielectric constant-time relationship diagram of an aerosol-generation product that is recently opened according to an embodiment of this application. FIG. 6 shows different preset heating curves outputted by a control unit according to a liquid content of the aerosol-generation product according to an embodiment of this application.

Referring to FIG. 1, an electronic vaporization device 20 is configured to heat and vaporize an aerosol-generation product 10. For example, a solid substrate of plant leaves with a specific aroma can generate an aerosol that has an obvious aroma and can satisfy users more effectively in a heating condition. The electronic vaporization device 20 bakes the solid substrate of plant leaves with a specific aroma in a heat-not-burning manner so that the solid substrate of leaves is baked into an aerosol. The electronic vaporization device 20 in this application is applicable to different fields, such as medical treatment, beauty treatment, or recreational smoking.

In an embodiment, the electronic vaporization device 20 is fixedly or detachably connected to the aerosol-generation product 10 to provide heating energy to the aerosol-generation product 10, so as to heat and vaporize an aerosol stored in the aerosol-generation product 10 to generate a substrate.

The inventors of this application found that a single traditional aerosol-generation product 10 or a plurality of traditional aerosol-generation products is/are usually packaged in a pack before use. After the aerosol-generation product 10 is opened, an aerosol-generation substrate in the package absorbs moisture in the air. Therefore, a later used aerosol-generation product 10 includes more moisture. For example, for a single aerosol-generation product 10 packaged in a pack, a longer waiting time since opening of the package to use leads to more moisture in the aerosol-generation product 10, or a longer waiting time since current suction to next suction leads to more moisture in the aerosol-generation product 10. For a plurality of aerosol-generation products 10 packaged in a pack, an aerosol-generation product 10 in the opened package used later than an aerosol-generation products 10 used earlier includes more moisture. Alternatively, the aerosol-generation product 10 includes other liquids caused by an misoperation of a user. As a result, the aerosol-generation product 10 cannot be heated and vaporized by the electronic vaporization and heating device to a preset temperature, resulting in a reduced volume of vaporized aerosols generated in the aerosol-generation product 10, and affecting user experience.

In an implementation, the control unit 23 further includes a sampling unit 24. The sampling unit 24 is configured to detect electrical parameters of the heating unit 21 and the aerosol-generation product 10, and the control unit 23 further obtains the liquid content of the aerosol-generation product 10 according to the electrical parameters detected by the sampling unit 24.

In an implementation, the control unit 23 further includes a sampling unit 24. The sampling unit 24 is configured to detect electrical parameters of the heating unit 21 and the aerosol-generation product 10, and the control unit 23 further obtains the liquid content of the aerosol-generation product 10 according to the electrical parameters detected by the sampling unit 23.

Referring to FIG. 3, the electronic vaporization device 20 further includes a first conductor 25 and a second conductor 26. The first conductor 25 and the second conductor 26 are electrically connected to the sampling unit 24. When the aerosol-generation product 10 is inserted into the electronic vaporization device 20, the first conductor 25 and the second conductor 26 come into contact with the aerosol-generation product 10 and are used as electrodes for the sampling unit 24 to collect electrical parameters on two ends of the aerosol-generation product 10. In an implementation, the first conductor 25 is configured to accommodate the aerosol-generation product 10, and the second conductor 26 is spaced apart from the first conductor 25. When the aerosol-generation product 10 is not inserted into the electronic vaporization device 20, the first conductor 25 and the second conductor 26 are insulated from each other. The aerosol-generation product 10 is conductive. When the aerosol-generation product 10 is inserted into the electronic vaporization device 20, the aerosol-generation product is electrically connected to the first conductor 25 and the second conductor 26, so that the first conductor 25 and the second conductor 26 are electrically connected by the aerosol-generation product 10.

The sampling unit 24 is configured to: apply a voltage between the first conductor 25 and the second conductor 26, collect an initial electrical parameter between the first conductor 25 and the second conductor 26 when the first conductor 25 and the second conductor 26 are not electrically connected by the aerosol-generation product 10, and collect an electrical parameter between the first conductor 25 and the second conductor 26 when the first conductor 25 and the second conductor 26 are electrically connected by the aerosol-generation product 10.

The electrical parameter is a capacitance value and/or a resistance value between the first conductor 25 and the second conductor 26.

The control unit 23 is configured to: obtain the liquid content of the aerosol-generation product 10 according to the electrical parameter detected by the sampling unit 24, and control, according to the liquid content of the aerosol-generation product 10, the heating element to heat the aerosol-generation product 10.

In an implementation, the first conductor 25 is a hollow columnar structure, such as a cylinder, and is connected to the sampling unit 24. The second conductor 26 may be plate-shaped or block-shaped, and is connected to the sampling unit 24 as a detection base. Materials of the first conductor 25 and the second conductor 26 may be metal, such as stainless steel. In an embodiment, the material of the first conductor 25 is metal, and the first conductor is configured to generate heat by induction in a magnetic field. The material of the second conductor 26 is conductive carbon or conductive ceramics, to prevent the second conductor 26 from generating heat by induction in the magnetic field and thereby causing uneven heating of the aerosol-generation product 10.

When the aerosol-generation product 10 is not inserted into the electronic vaporization device 20, an electrical signal loop cannot be formed between the first conductor 25 and the second conductor 26 due to the spaced arrangement. In this case, the sampling unit 24 denotes an electrical parameter between the first conductor 25 and the second conductor 26 as the initial electrical parameter. When the aerosol-generation product 10 is inserted into the electronic vaporization device 20, the aerosol-generation product 10 is in sufficient contact with the first conductor 25, and electrically connects the first conductor 25 to the second conductor 26, which changes the capacitance value and the resistance value between the first conductor 25 and the second conductor 26. The sampling unit 24 collects the electrical parameter between the first conductor 25 and the second conductor 26 again. The control unit 23 compares the initial electrical parameter collected by the sampling unit 24 with the electrical parameter after the first conductor 25 and the second conductor 26 are electrically connected, obtains a first difference between the two electrical parameters through algorithm filtering, compares the difference with a preset threshold to obtain a second difference, and obtains the liquid content of the aerosol-generation product 10 according to the second difference by table look-up or calculation. The liquid content of the aerosol-generation product 10 found through table look-up according to the preset threshold and the second difference is obtained by experiments and tests, and is pre-stored in the control unit 23.

The first conductor 25 and the second conductor 26 are equivalent to a transceiver for capacitance sensing and resistance measurement, which receives and sends a capacitance sensing signal and a resistance change signal.

In an implementation, the heating unit 21 further includes an insulator 27 arranged between the first conductor 25 and the second conductor 26 for spacing the first conductor 25 apart from the second conductor 26. The insulator 27 has a through hole, and the aerosol-generation product 10 can pass through the first conductor 25 and the insulator 27 and is electrically connected to the second conductor 26. In an embodiment, the insulator 27 is an annular body. The first conductor 25 is arranged on a top of the insulator 27 and is arranged coaxially with the insulator 27, and the second conductor 26 is arranged on a bottom of the insulator 27 and covers the bottom of the insulator 27. The second conductor 26 also has an air inlet hole in communication with inside of the insulator 27.

In a specific implementation, the insulator 27 is an annular body with a flange on an inner wall. An upper surface of the flange abuts against a bottom end of the first conductor 25, and an outer sidewall of the first conductor 25 abuts against an inner sidewall of the insulator 27. The second conductor 26 is arranged on a lower surface of the flange and covers the bottom of the insulator 27. The first conductor 25, the second conductor 26, and the insulator 27 may be in interference fit or may be bonded, so as to simplify an assembly process of the electronic vaporization device.

In an embodiment, the heating unit 21 performs electromagnetic heating. Specifically, the first conductor 25 is further used as a heating element, and the heating unit 21 further includes an electromagnetic coil, and the electromagnetic coil surrounds the first conductor 25. Therefore, when electrified, the first conductor 25 generates heat by electromagnetic induction to heat and vaporize the aerosol-generation product 10.

In another embodiment, the heating unit 21 performs resistive heating, and the heating unit 21 is a heating element arranged independently. The heating element may be a centrally needle-shaped or centrally sheet-shaped heating element, is arranged on the second conductor 26, and is configured to be inserted into the aerosol-generation product 10 to heat and vaporize the aerosol-generation product 10.

In an embodiment, the electronic vaporization device 20 further includes a detection unit for detecting whether the aerosol-generation product 10 is inserted into the electronic vaporization device 20. When it is detected that the aerosol-generation product 10 is inserted into the electronic vaporization device 20, the sampling unit 24 and the control unit 23 collect and obtain the liquid content of the aerosol-generation product 10. In some optional embodiments, the sampling unit 24 may be used as a detection unit. For example, the sampling unit 24 constantly applies a voltage between the first conductor 25 and the second conductor 26 to collect at any time the initial electrical parameter and the electrical parameter after the first conductor 25 and the second conductor 26 are electrically connected, and send the electrical parameters to the control unit 23 for calculation to obtain the liquid content of the aerosol-generation product 10. When it is detected that the electrical insulation between the first conductor 25 and the second conductor 26 changes to electrical connection, it is determined that the aerosol-generation product 10 is inserted into the electronic vaporization device 20. In this way, it can be ensured that detection of the liquid content is initiated each time the aerosol-generation product 10 is replaced with a new one. In another optional implementation, the detection unit may be an optical sensor arranged on the inner sidewall of the insulator 27 to detect by optical sensing whether the aerosol-generation product 10 is inserted into the electronic vaporization device 20. Alternatively, the detection unit may be a pressure sensor arranged on the second conductor 26 to detect by pressure sensing whether the aerosol-generation product 10 is inserted into the electronic vaporization device 20. The sampling unit 24 may alternatively start to apply a voltage between the first conductor 25 and the second conductor 26 when the detection unit detects that the aerosol-generation product 10 is inserted into the electronic vaporization device 20, collect the electrical parameter after the first conductor 25 and the second conductor 26 are electrically connected, and send the collected electrical parameter to the control unit 23. The control unit 23 compares the pre-stored initial electrical parameter with the electrical parameter after the first conductor 25 and the second conductor 26 are electrically connected, to obtain the liquid content of the aerosol-generation product 10. A specific implementation may be selected according to actual requirements, which is not limited herein.

An aerosol-generation product 10 that is not pulled out of the electronic vaporization device 20 and has been used for a long time absorbs moisture with time. Therefore, in this application, the detection unit is further configured to determine a time interval from a last inhale signal after detecting an inhale signal of a user. If the time interval exceeds a preset time threshold, the sampling unit 24 and the control unit 23 collect and obtain the liquid content of the aerosol-generation product 10 again. The preset time threshold may be 4 hours, 8 hours, or 24 hours, which is selected according to a situation. If the local climate is humid, the preset time threshold may be properly reduced. If the local climate is dry, the preset time threshold may be properly increased.

The control unit 23 controls, according to the liquid content of the aerosol-generation product 10, the heating unit 21 to heat the aerosol-generation product 10. For a method for heating the aerosol-generation product, relevant data may be obtained in advance by experiments and pre-stored in the control unit 23. Specifically, in normal cases, a time the electronic vaporization device 20 preheats the aerosol-generation product 10 is generally 15-25 seconds, and a preheating temperature is 240-250 degrees Celsius. A total power for preheating an aerosol-generation product 10 that is recently opened, that is, that does not absorb moisture, may be calculated according to a heating voltage and a heating resistance.

TABLE 1

Power required for each preheating temperature for aerosol-generation products

| Time S | Voltage V | Temperature ° C. | TCR ppm | Initial resistance Ω | Actual resistance Ω | Power W | Energy J |
|---|---|---|---|---|---|---|---|
| 0 | 5 | 29 | 1700 | 0.92 | 0.934076 | 26.76441746 | 0 |
| 1 | 5 | 47 | 1700 | 0.92 | 0.962228 | 25.98136824 | 26.37289285 |
| 2 | 5 | 90 | 1700 | 0.92 | 1.02948 | 24.2841046 | 25.13273642 |
| 3 | 5 | 111 | 1700 | 0.92 | 1.062324 | 23.53330999 | 23.90870729 |
| 4 | 5 | 134 | 1700 | 0.92 | 1.098296 | 22.76253396 | 23.14792197 |
| 5 | 5 | 155 | 1700 | 0.92 | 1.13114 | 22.10159662 | 22.43206529 |
| 6 | 5 | 172 | 1700 | 0.92 | 1.157728 | 21.59401863 | 21.84780762 |
| 7 | 5 | 189 | 1700 | 0.92 | 1.184316 | 21.10923096 | 21.35162481 |
| 8 | 5 | 205 | 1700 | 0.92 | 1.20934 | 20.6724329 | 20.89083194 |
| 9 | 5 | 219 | 1700 | 0.92 | 1.231236 | 20.3047994 | 20.48861615 |
| 10 | 5 | 231 | 1700 | 0.92 | 1.250004 | 19.999936 | 20.1523677 |
| 11 | 5 | 234 | 1700 | 0.92 | 1.154696 | 19.92514521 | 19.96254061 |
| 12 | 5 | 235 | 1700 | 0.92 | 1.25626 | | 9.962572607 |
| 13 | 5 | 236 | 1700 | 0.92 | 1.257824 | 19.87559467 | 9.937797339 |
| 14 | 5 | 235 | 1700 | 0.92 | 1.25626 | | 9.937797339 |
| 15 | 5 | 237 | 1700 | 0.92 | 1.259388 | | 0 |
| 16 | 5 | 239 | 1700 | 0.92 | 1.262516 | | 0 |
| 17 | 5 | 242 | 1700 | 0.92 | 1.267208 | 19.72841081 | 9.864205403 |
| 18 | 5 | 242 | 1700 | 0.92 | 1.267208 | | 9.864205403 |
| 19 | 5 | 241 | 1700 | 0.92 | 1.265644 | | 0 |
| 20 | 5 | 243 | 1700 | 0.92 | 1.268772 | | 0 |
| | | | Total generated heat | | | | 295.2546907 |

Referring to Table 1, it may be learned that the heating element is equivalent to a thermistor, an initial resistance of the heating element is 0.92Ω, and an actual resistance of the heating element varies with a heating temperature.

Since the aerosol-generation product 10 absorbs moisture after being opened, a weight of a single aerosol-generation product 10 increases. Energy power consumption for additional water evaporation may be calculated according to a specific heat capacity of water and heat absorbed by water evaporation.

TABLE 2

Heat and power consumption for water evaporation in aerosol-generation products

| Time after opening | Unit | Recently opened | 1 day after opening |
|---|---|---|---|
| Weight of 20 pieces | g | 10.9567 | 11.3034 |
| Per weight | g | 0.547835 | 0.56517 |
| Amount of absorbed water | g | 0 | 0.017335 |
| Specific heat capacity of water | J/g*° C. | 4.2 | 4.2 |
| Heat absorbed as a result of a temperature rise from 25° C. to 100° C. | J | 0 | 5.460525 |
| Latent heat | J/g | 2256 | 2256 |
| Heat absorbed as a result of evaporation | J | 0 | 39.10776 |
| Specific heat capacity of water vapor | J/g*° C. | 1.85 | 1.85 |
| Heat absorbed as a result of a temperature rise from 100° C. to 110° C. | J | 0 | 0.3206975 |
| Total absorbed heat | J | 0 | 44.8889825 |

As shown in Table 2, a boiling point of water is 100 degrees Celsius. Therefore, after the aerosol-generation product 10 that absorbed moisture is preheated to 100 degrees Celsius, the liquid content of the aerosol-generation product 10 approximates 0. After continuous heating, heat and power consumption for the liquid evaporation are substantially 0.

Referring to FIG. 4 and FIG. 5, after the aerosol-generation product 10 is inserted into the first conductor 25, the sampling unit 24 detects an electrical parameter of the aerosol-generation product 10. A dielectric constant of an aerosol-generation product 10 after one day since opening (shown in FIG. 4) and an aerosol-generation product that is recently opened (shown in FIG. 5) are significantly different, indicating that the liquid contents are significantly different. Specifically, before the aerosol-generation product is inserted into the first conductor 25, the control unit 23 constantly calibrates the current potential data as reference potential data, as shown by a line B in the figure. After the aerosol-generation product is inserted into the first conductor 25, the potential data changes, as shown by a line A in the figure. The control unit determines the liquid content in the aerosol-generation product 10 by determining the change of the line A relative to the line B, and determines, by experiments, an amount of heat to be compensated or a heating curve to be used for the aerosol-generation product 10 with a different liquid content. The control unit 23 pre-stores the relevant experiment data, obtains the liquid content of the aerosol-generation product 10 according to the relevant electrical parameter detected by the sampling unit 24, and controls, according to the liquid content, the heating element to heat the aerosol-generation product 10.

Specifically, the control unit 23 obtains the liquid content of the aerosol-generation product 10 by calculation and comparison. In an implementation, the control unit 23 includes a microcontroller unit (MCU) 23. The MCU receives the electrical parameters fed back by the sampling unit 24, determines the liquid content of the aerosol-generation product 10, obtains a preset heating curve matching the liquid content of the aerosol-generation product based on the liquid content of the aerosol-generation product 10, and controls the heating element to heat the aerosol-generation product 10.

In an embodiment, referring to FIG. 6, a preset heating curve set corresponding to different liquid contents in the aerosol-generation product 10 are pre-stored in the control unit 23. The control unit 23 selects a preset heating curve matching a liquid content of a current aerosol-generation product 10 from the pre-stored preset heating curve set. A time and/or a temperature in a different preset heating curve in the preset heating curve set for preheating the aerosol-generation product 10 varies.

For example, when the liquid content of the aerosol-generation product 10 is 0 or lower than a threshold, the time for preheating the aerosol-generation product 10 by the electronic vaporization device 20 is 20 seconds, the preheating temperature is 250 degrees Celsius, and the control unit 23 outputs a standard heating curve. When the liquid content of the aerosol-generation product 10 is higher than the threshold, the control unit 23 outputs a heating curve that has a longer preheating time such as 23 seconds or 25 seconds for the aerosol-generation product 10 than the standard heating curve or that has a higher preheating temperature such as 255 degrees Celsius or 260 degrees Celsius for the aerosol-generation product 10. Alternatively, the preheating temperature and the preheating time for the aerosol-generation product 10 both may be increased, so that the aerosol-generation product 10 can be preheated to a target temperature. In one embodiment, a plurality of threshold intervals may be set, and different heating curves are pre-stored for the different threshold intervals. A corresponding heating curve is selected according to a threshold interval corresponding to the liquid content of the aerosol-generation product 10.

Alternatively, the standard heating curve may be a heating curve when the liquid content of the aerosol-generation product 10 is a certain value, such as a heating curve in a liquid saturated state. When the liquid content of the aerosol-generation product 10 is lower than a saturation value, the control unit 23 may output a heating curve that has a shorter preheating time or a lower preheating temperature for the aerosol-generation product 10 than the standard heating curve. No limitation is imposed herein.

In another implementation, the control unit 23 may compensate for the pre-stored preset heating curve according to the liquid content of the aerosol-generation product 10, so as to change the time and/or the temperature in the preset heating curve for preheating the aerosol-generation product 10. For example, a preset heating curve is stored in the control unit 23, and the preset heating curve corresponds to a certain value of the liquid content of the aerosol-generation product 10. After obtaining the liquid content of the aerosol-generation product 10, the control unit 23 performs logical calculation on the preset heating curve to obtain and output a compensated heating curve, so as to increase or reduce the preheating time or the preheating temperature for the aerosol-generation product 10, so that the aerosol-generation product 10 can be heated to a preset temperature. Specifically, the control unit 23 compensates for the preset heating curve before outputting the heating curve. It may be understood that, in this method, a correspondence table or a relationship expression of the liquid content of the aerosol-generation product 10 and a compensation value is required to be pre-stored, and compensation is performed according to a compensation value corresponding to the liquid content of the aerosol-generation product 10.

The electronic vaporization device 20 provided in this application detects the liquid content of the aerosol-generation product 10 before heating the aerosol-generation product 10, and outputs a corresponding heating curve according to the liquid content of the aerosol-generation product 10. Therefore, the aerosol-generation products 10 with different liquid contents can be fully heated, thereby effectively improving user experience.

Figure 7:
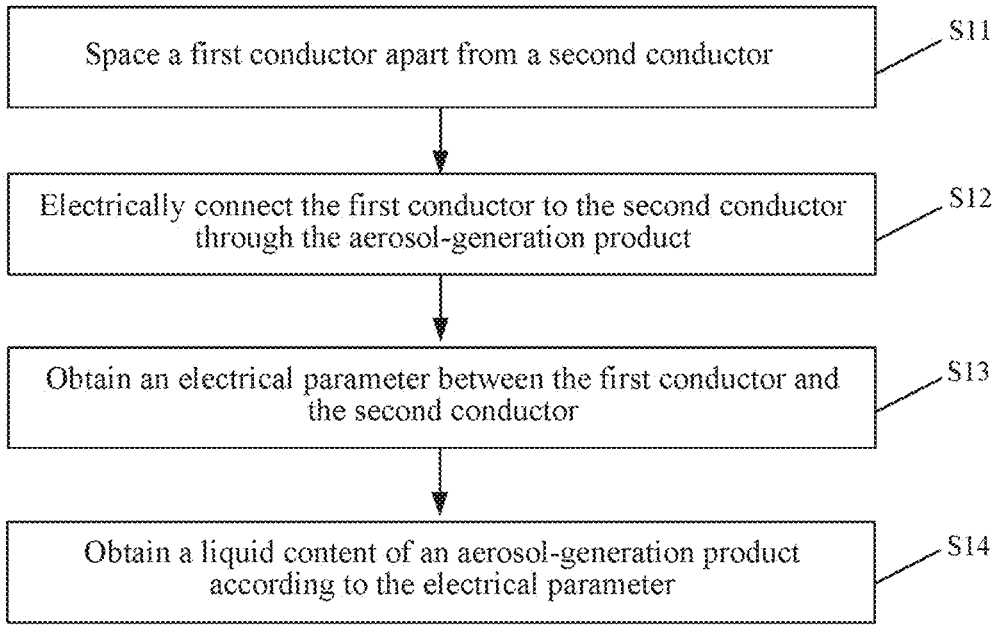
FIG. 7 is a schematic flowchart of a method for detecting a liquid content in an aerosol-generation product according to an embodiment of this application.

FIG. 7 is a schematic flowchart of a method for detecting a liquid content in an aerosol-generation product according to an embodiment of this application. The method specifically includes the following steps:

Step S11: Space a first conductor apart from a second conductor.

Specifically, the first conductor is spaced apart from the second conductor to block conductivity between the first conductor and the second conductor.

Step S12: Electrically connect the first conductor to the second conductor through the aerosol-generation product.

The aerosol-generation product is conductive. When the aerosol-generation product is inserted into the electronic vaporization device, the aerosol-generation product is in full contact with the first conductor, and electrically connects the first conductor to the second conductor. The first conductor and the second conductor are equivalent to a transceiver for capacitance sensing and resistance measurement, which receives and sends a capacitance sensing signal and a resistance change signal.

Step S13: Obtain an electrical parameter between the first conductor and the second conductor.

Specifically, when the first conductor and the second conductor are electrically connected, the capacitance value and the resistance value between the first conductor and the second conductor change, and the sampling unit collects the electrical parameter between the first conductor and the second conductor.

Step S14: Obtain a liquid content of the aerosol-generation product according to the electrical parameter.

Specifically, the control unit obtains the liquid content of the aerosol-generation product according to the obtained electrical parameter, and controls a power output to the heating unit to heat the aerosol-generation product.

Figure 8:
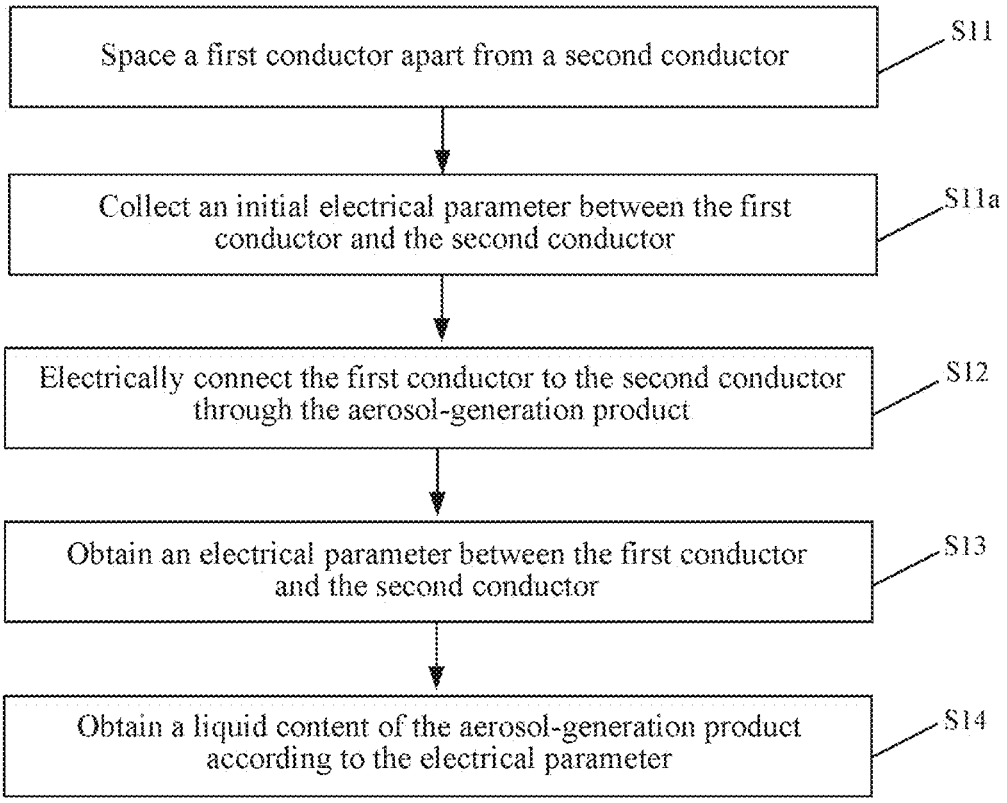
FIG. 8 is a schematic flowchart of a method for detecting a liquid content in an aerosol-generation product according to another embodiment of this application.

FIG. 8 is a schematic flowchart of a method for detecting a liquid content in an aerosol-generation product according to another embodiment of this application. A difference from the method shown in FIG. 5 lies in that before step S12 of electrically connecting first conductor to second conductor through the aerosol-generation product, the method further includes the following step:

Step S11*a*: Collect an initial electrical parameter between the first conductor and the second conductor.

Specifically, an electrical signal loop cannot be formed between the first conductor and the second conductor due to the spaced arrangement. In this case, the sampling unit denotes an electrical parameter between the first conductor and the second conductor as the initial electrical parameter. The electrical parameter includes a capacitance value and/or a resistance value. The sampling unit denotes the capacitance sensing signal as C1 and the resistance signal as R1.

Figure 9:
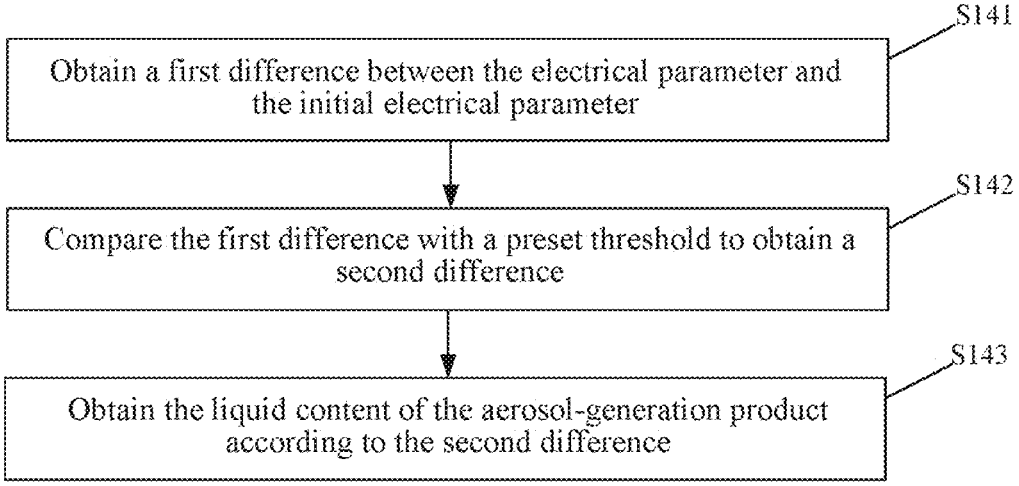
FIG. 9 is a schematic flowchart of an implementation of step S14 in FIG. 5 according to an embodiment of this application.

FIG. 9 is a schematic flowchart of an implementation of step S14 in FIG. 7 according to an embodiment of this application. Step S14 specifically includes the following steps:

Step S141: Obtain a first difference between the electrical parameter and the initial electrical parameter.

The initial electrical parameter is an electrical parameter when the first conductor and the second conductor are not electrically connected by the aerosol-generation product. Specifically, the sampling unit collects the initial electrical parameter when the first conductor and the second conductor are not electrically connected and the electrical parameter after the first conductor and the second conductor are electrically connected, and sends the electrical parameters to the control unit. The control unit compares the initial electrical parameter collected by the sampling unit with the electrical parameter after the first conductor and the second conductor are electrically connected, and obtains the first difference between the two electrical parameters by algorithm filtering.

Step S142: Compare the first difference with a preset threshold to obtain a second difference.

Specifically, the control unit compares the first difference with the preset threshold pre-stored in the control unit to obtain the second difference.

Step S143: Obtain the liquid content of the aerosol-generation product according to the second difference.

Specifically, the liquid content of the aerosol-generation product is obtained according to the second difference by table look-up or calculation. The liquid content of the aerosol-generation product 10 found through table look-up according to the second difference is obtained by experiments and tests, and is pre-stored in the control unit.

In the method for detecting a liquid content in an aerosol-generation product provided in this application, the initial electrical parameter when the first conductor and the second conductor are not electrically connected is collected, the electrical parameter after the first conductor and the second conductor are electrically connected by the aerosol-generation product is obtained, and the two electrical parameters are compared, so that the liquid content in the aerosol-generation product can be obtained. The detection method is simple and has high reliability.

Figure 10:
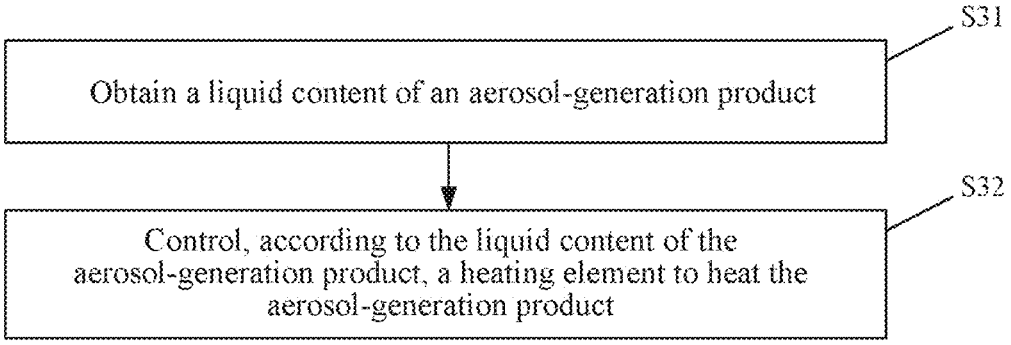
FIG. 10 is a schematic flowchart of a method for controlling heating performed by an electronic vaporization device according to an embodiment of this application.

FIG. 10 is a schematic flowchart of a method for controlling heating performed by an electronic vaporization device according to an embodiment of this application. The method specifically includes the following steps:

Step S31: Obtain a liquid content of an aerosol-generation product.

Specifically, before the electronic vaporization device heats the aerosol-generation product, the liquid content of the aerosol-generation product is obtained.

Step S32: Control, according to the liquid content of the aerosol-generation product, a heating element to heat the aerosol-generation product.

Specifically, a control unit of the electronic vaporization device obtains a preset heating curve matching the liquid content of the aerosol-generation product according to the liquid content of the aerosol-generation product, and controls the heating element to heat the aerosol-generation product.

Figure 11:
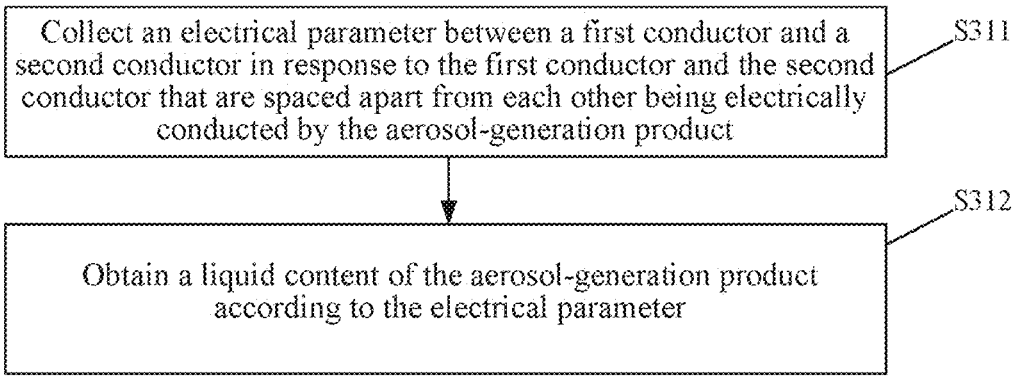
FIG. 11 is a schematic flowchart of an implementation of step S31 in FIG. 10 according to an embodiment of this application.

FIG. 11 is a schematic flowchart of an implementation of step S31 in FIG. 10 according to an embodiment of this application. Step S31 specifically includes the following steps:

Step S311: Collect an electrical parameter between the first conductor and the second conductor in response to the first conductor and the second conductor that are spaced apart from each other being electrically connected by the aerosol-generation product.

Specifically, when the aerosol-generation product is inserted into the electronic vaporization device, the aerosol-generation product is in full contact with the first conductor, and electrically connects the first conductor to the second conductor. A sampling unit in the electronic vaporization device applies a voltage to the first conductor and the second conductor and collects the electrical parameter between the first conductor and the second conductor. The electrical parameter includes a capacitance value and/or a resistance value.

Step S312: Obtain a liquid content of the aerosol-generation product according to the electrical parameter.

Specifically, the control unit is connected to the sampling unit, and the control unit obtains the liquid content of the aerosol-generation product according to the electrical parameter collected by the sampling unit.

Figure 12:
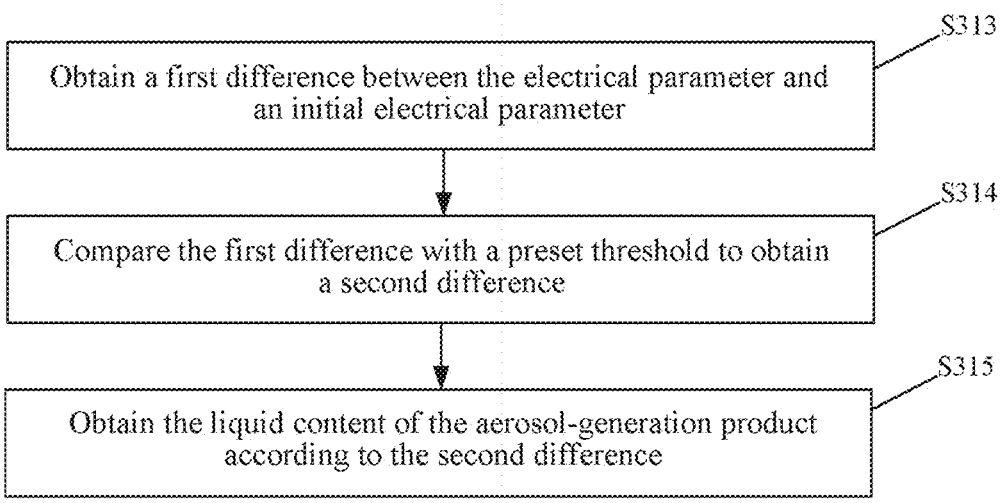
FIG. 12 is a schematic flowchart of an implementation of step S312 in FIG. 11 according to an embodiment of this application.

FIG. 12 is a schematic flowchart of an implementation of step S312 in FIG. 11 according to an embodiment of this application. Step S312 specifically includes the following steps:

Step S313: Obtain a first difference between the electrical parameter and the initial electrical parameter.

The initial electrical parameter is an electrical parameter when the first conductor and the second conductor are not electrically connected by the aerosol-generation product. Specifically, when the aerosol-generation product is not inserted into the electronic vaporization device, an electrical signal loop cannot be formed between the first conductor and the second conductor due to the spaced arrangement. In this case, the sampling unit denotes an electrical parameter between the first conductor and the second conductor as the initial electrical parameter.

Further, the sampling unit sends the collected initial electrical parameter and the obtained electrical parameter after the first conductor and the second conductor are electrically connected to the control unit. The control unit compares the initial electrical parameter collected by the sampling unit with the electrical parameter after the first conductor and the second conductor are electrically connected, and obtains the first difference between the two electrical parameters by algorithm filtering.

Step S314: Compare the first difference with a preset threshold to obtain a second difference.

Specifically, the control unit compares the first difference with the preset threshold pre-stored in the control unit to obtain the second difference.

Step S315: Obtain the liquid content of the aerosol-generation product according to the second difference.

Specifically, the liquid content of the aerosol-generation product is obtained according to the second difference by table look-up or calculation. The liquid content of the aerosol-generation product 10 found through table look-up according to the second difference is obtained by experiments and tests, and is pre-stored in the control unit.

Figure 13:
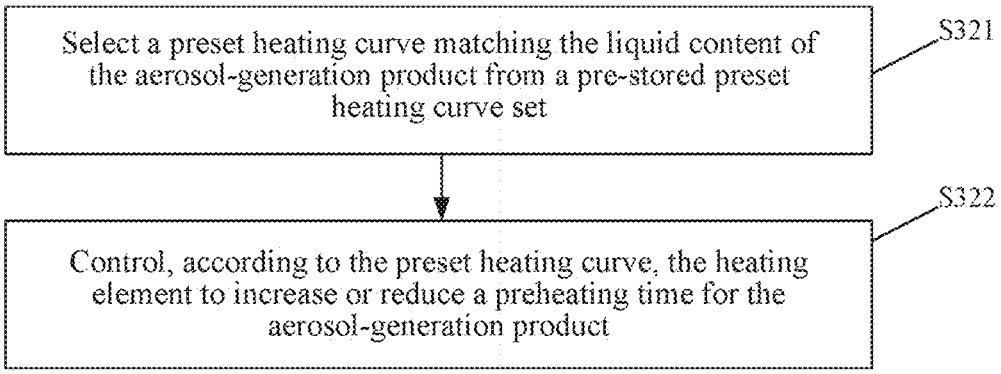
FIG. 13 is a schematic flowchart of an implementation of step S32 in FIG. 10 according to an embodiment of this application.

FIG. 13 is a schematic flowchart of an implementation of step S32 in FIG. 10 according to an embodiment of this application. Step S32 specifically includes the following steps:

Step S321: Select a preset heating curve matching the liquid content of the aerosol-generation product from a pre-stored preset heating curve set.

A time and/or a temperature in a different preset heating curve in the preset heating curve set for preheating the aerosol-generation product varies. Specifically, a preset heating curve set corresponding to different liquid contents in the aerosol-generation product are pre-stored in the control unit, and a time and/or a temperature in the preset heating curve set for preheating the aerosol-generation product by using the heating element varies. The control unit may select a preset heating curve matching the liquid content of the current aerosol-generation product from the pre-stored preset heating curve set to heat the aerosol-generation product.

Step S322: Control, according to the preset heating curve, the heating element to increase or reduce the preheating time for the aerosol-generation product.

For example, when the liquid content of the aerosol-generation product is 0, the time for preheating the aerosol-generation product by the electronic vaporization device is 20 seconds, the preheating temperature is 250 degrees Celsius, and the preset heating curve obtained by the control unit is a standard heating curve. When the liquid content of the aerosol-generation product is relatively high, the preset heating curve obtained by the control unit has a longer preheating time such as 23 seconds or 25 seconds for the aerosol-generation product than the standard heating curve or has a higher preheating temperature such as 255 degrees Celsius or 260 degrees Celsius for the aerosol-generation product. Alternatively, the preheating temperature and the preheating time for the aerosol-generation product both may be increased, so that the aerosol-generation product can be preheated to a target temperature.

Alternatively, the standard heating curve may be a heating curve when the liquid content of the aerosol-generation product is a certain value. When the liquid content of the aerosol-generation product is lower than the value, the control unit may obtain a heating curve that has a shorter preheating time or a lower preheating temperature for the aerosol-generation product than the standard heating curve.

In another implementation, different from the above steps S321-S322, step S32 includes: compensating the pre-stored preset heating curve according to the liquid content of the aerosol-generation product, so as to change the time and/or the temperature in the preset heating curve for preheating the aerosol-generation product.

Specifically, a preset heating curve is stored in the control unit, and the preset heating curve corresponds to a certain value of the liquid content of the aerosol-generation product. After obtaining the liquid content of the aerosol-generation product, the control unit performs logical calculation on the preset heating curve to obtain and output a compensated heating curve, so as to increase or reduce the preheating time or the preheating temperature for the aerosol-generation product, so that the aerosol-generation product can be heated to a preset temperature. The control unit compensates for the preset heating curve before outputting the heating curve.

In the heating method of the electronic vaporization device provided in this application, different heating curves may be outputted for the heating element according to the liquid content of the aerosol-generation product, so as to increase or reduce the preheating time or the preheating temperature for the aerosol-generation product, so that the aerosol-generation product can be heated to a preset temperature, thereby improving user experience.

The foregoing descriptions are merely embodiments of this application, and the protection scope of this application is not limited thereto. All equivalent structure or process changes made according to the content of this specification and accompanying drawings in this application or by directly or indirectly applying this application in other related technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electronic vaporization device, comprising:

a first conductor configured to accommodate an aerosol-generation product;

a second conductor spaced apart from the first conductor; and a control unit configured to: obtain an electrical parameter between the first conductor and the second conductor when the first conductor and the second conductor are electrically connected by the aerosol-generation product, obtain a liquid content of the aerosol-generation product according to the electrical parameter, and control, according to the liquid content of the aerosol-generation product, a heating element to heat the aerosol-generation product, wherein the control unit further comprises a sampling unit configured to collect the electrical parameter between the first conductor and the second conductor when the first conductor and the second conductor are electrically connected by the aerosol-generation product, and wherein the sampling unit is configured to collect an initial electrical parameter between the first conductor and the second conductor when the first conductor and the second conductor are not electrically connected by the aerosol-generation product.

2. The electronic vaporization device of claim 1, wherein the control unit is configured to: obtain a first difference between the electrical parameter and the initial electrical parameter, compare the first difference with a preset threshold to obtain a second difference, and obtain a liquid content of the aerosol-generation product according to the second difference.

3. The electronic vaporization device of claim 1, wherein the control unit is configured to control, based on the liquid content of the aerosol-generation product, the heating element to heat the aerosol-generation product.

4. The electronic vaporization device of claim 3, wherein the control unit is configured to select a preset heating curve matching the liquid content of the aerosol-generation product from a pre-stored preset heating curve set, and wherein a time and/or a temperature in a different preset heating curve in the preset heating curve set for preheating the aerosol-generation product varies.

5. The electronic vaporization device of claim 3, wherein the control unit is configured to compensate for the pre-stored preset heating curve according to the liquid content of the aerosol-generation product so as to change a time and/or a temperature in the preset heating curve for preheating the aerosol-generation product.

6. The electronic vaporization device of claim 1, wherein the first conductor comprises a hollow columnar body and is used as the heating element.

7. The electronic vaporization device of claim 6, further comprising:

an electromagnetic coil surrounding the first conductor, wherein the first conductor is configured to generate heat by electromagnetic induction.

8. The electronic vaporization device of claim 6, further comprising:

an insulator arranged between the first conductor and the second conductor for spacing the first conductor apart from the second conductor, wherein the insulator has a through hole, and wherein the aerosol-generation product passes through the first conductor and the insulator and is electrically connected to the second conductor.

9. The electronic vaporization device of claim 1, wherein the electrical parameter comprises a capacitance value and/or a resistance value.

10. A liquid content detection method for detecting a liquid content of an aerosol-generation product, comprising:

spacing a first conductor apart from a second conductor;

electrically connecting the first conductor to the second conductor through the aerosol-generation product;

obtaining an electrical parameter between the first conductor and the second conductor; and obtaining a liquid content of the aerosol-generation product according to the electrical parameter, wherein obtaining the liquid content of the aerosol-generation product according to the electrical parameter comprises:

obtaining a first difference between the electrical parameter and an initial electrical parameter, the initial electrical parameter being an electrical parameter when the first conductor and the second conductor are not electrically connected by the aerosol-generation product;

comparing the first difference with a preset threshold to obtain a second difference; and obtaining the liquid content of the aerosol-generation product according to the second difference.

11. The detection method of claim 10, wherein before electrically connecting the first conductor to the second conductor through the aerosol-generation product, the method further comprises:

collecting the initial electrical parameter between the first conductor and the second conductor.

12. The detection method of claim 10, wherein the electrical parameter comprises a capacitance value and/or a resistance value.

13. A heating method of an electronic vaporization device, comprising:

obtaining a liquid content of an aerosol-generation product; and controlling, according to the liquid content of the aerosol-generation product, a heating element to heat the aerosol-generation product, wherein controlling, according to the liquid content of the aerosol-generation product, a heating element to heat the aerosol-generation product, comprises:

compensating the pre-stored preset heating curve according to the liquid content of the aerosol-generation product so as to change a time and/or a temperature in the preset heating curve for preheating the aerosol-generation product.

14. The heating method of claim 13, wherein obtaining the liquid content of the aerosol-generation product comprises:

collecting an electrical parameter between the first conductor and the second conductor in response to the first conductor and the second conductor that are spaced apart from each other being electrically connected by the aerosol-generation product; and obtaining a liquid content of the aerosol-generation product according to the electrical parameter.

15. The heating method of claim 14, wherein obtaining the liquid content of the aerosol-generation product according to the electrical parameter comprises:

obtaining a first difference between the electrical parameter and an initial electrical parameter, the initial electrical parameter being an electrical parameter when the first conductor and the second conductor are not electrically connected by the aerosol-generation product;

comparing the first difference with a preset threshold to obtain a second difference; and obtaining the liquid content of the aerosol-generation product according to the second difference.

16. The heating method of claim 13, wherein controlling, according to the liquid content of the aerosol-generation product, a heating element to heat the aerosol-generation product, comprises:

selecting a preset heating curve matching the liquid content of the aerosol-generation product from a pre-stored preset heating curve set, a time and/or a temperature in a different preset heating curve in the preset heating curve set for preheating the aerosol-generation product varying; and controlling, according to the preset heating curve, the heating element to increase or reduce a preheating time for the aerosol-generation product.

17. The heating method of claim 14, wherein the electrical parameter comprises a capacitance value and/or a resistance value.

* * * * *